US011384293B2

(12) United States Patent
Corscadden et al.

(10) Patent No.: US 11,384,293 B2
(45) Date of Patent: Jul. 12, 2022

(54) DIRECT OLEFIN REDUCTION OF THERMALLY CRACKED HYDROCARBON STREAMS

(71) Applicant: SUNCOR ENERGY INC., Calgary (CA)

(72) Inventors: Tom Corscadden, Calgary (CA); Darius Ramesat, Calgary (CA); Frank David Guffey, Laramie, WY (US); Shunlan Liu, Calgary (CA); Greg Diduch, Calgary (CA)

( * ) Notice: Subject to any disclaimer, the term of this patent is extended or adjusted under 35 U.S.C. 154(b) by 0 days.

(21) Appl. No.: 16/807,880

(22) Filed: Mar. 3, 2020

(65) Prior Publication Data

US 2020/0199461 A1 Jun. 25, 2020

Related U.S. Application Data

(63) Continuation of application No. 15/596,816, filed on May 16, 2017, now Pat. No. 10,619,109.

(60) Provisional application No. 62/337,084, filed on May 16, 2016.

(51) Int. Cl.

| | |
|---|---|
| ***C10G 9/00*** | (2006.01) |
| ***C10G 11/02*** | (2006.01) |
| ***C10G 29/04*** | (2006.01) |
| ***C10G 51/04*** | (2006.01) |
| ***C10G 53/02*** | (2006.01) |
| ***C10G 53/08*** | (2006.01) |

(52) U.S. Cl.
CPC ..... *C10G 29/04* (2013.01); *C10G 53/02* (2013.01); *C10G 53/08* (2013.01); *C10G 2400/30* (2013.01)

(58) Field of Classification Search
CPC ..... C10G 9/00; C10G 11/02; C10G 29/04; C10G 51/04; C10C 3/023
See application file for complete search history.

(56) References Cited

U.S. PATENT DOCUMENTS 3,849,545 A * 11/1974 Miklas ..... B01J 37/03 423/594.2

FOREIGN PATENT DOCUMENTS

CA 2916767 A1 * 1/2015 ..... C10G 29/20

* cited by examiner

*Primary Examiner* — Randy Boyer
(74) *Attorney, Agent, or Firm* — Bradley Arant Boult Cummings; Timothy L. Capria; Alexandra C. Lynn

(57) ABSTRACT

A process that catalytically converts olefinic (Alkenes, typically liquid at standard temperature and pressure) material in thermally cracked streams to meet olefin content specifications for crude oil transport pipelines. A thermally cracked stream or portion of a thermally cracked stream is selectively reacted to reduce the olefin content within a reactor operating at specific, controlled conditions in the presence of a catalyst and the absence of supplemental hydrogen. The process catalyst is comprised of a blend of select catalyzing metals supported on an alumina, silica or shape selective zeolite substrate together with appropriate pore acidic components.

29 Claims, 2 Drawing Sheets

DIRECT OLEFIN REDUCTION OF THERMALLY CRACKED HYDROCARBON STREAMS

FIELD OF THE INVENTION

A process that catalytically converts olefinic (Alkenes, typically liquid at standard temperature and pressure) material in thermally cracked streams to meet olefin content specifications for crude oil transport pipelines. A thermally cracked stream or portion of a thermally cracked stream is selectively reacted to reduce the olefin content within a reactor operating at specific, controlled conditions in the presence of a catalyst and the absence of supplemental hydrogen. The process catalyst is comprised of a blend of select catalyzing metals supported on an alumina, silica or shape selective zeolite substrate together with appropriate pore acidic components.

DESCRIPTION OF PRIOR ART

Canadian patent 2,916,767 and U.S. Patent application 61/843,002 describe a process to convert olefins in a thermally cracked stream to meet crude pipeline specifications. Alkylation chemistry using strong acidic solid catalysts is the chosen reaction pathway. Alkylation uses strong acids (Sulfuric acid ($H_2SO_4$) and hydrofluoric acid (HF)) to catalyze the reaction of olefins and aromatic molecules. Alkylation is well proven with some commercial application in refineries, however the severely corrosive nature of the catalyzing acids has limited its adoption. The cost of containment and use of these acids together with the cost of pre-treatment to remove contaminants that deactivate the catalyst has caused refiners to seek different paths. The embodiment described by Canadian patent 2,916,767 and U.S. Patent application 61/843,002 utilize the same chemistry pathway but seeks to avoid or reduce the high acid management costs by employing a solid form of acid. The proposed chemistry does not require supplementary olefins or aromatics to generate the alkylation reaction claiming that all of the necessary molecules are present in the thermally cracked bitumen stream. However, this proposed stream also contains molecules with bound nitrogen and other non-hydrocarbon constituents which are known to rapidly deactivate strong acid catalysts. In current refining applications, these contaminants are strictly managed in a pre-treatment typically requiring supplemental hydrogen. While a solid form acid catalyst could potentially deliver the desired reaction chemistry reducing the costs of catalyst management, the risks of catalyst deactivation together with the cost of pre-treatment, including hydrogen, to remove the bound nitrogen contaminants is likely to limit the adoption of the process.

U.S. Pat. No. 6,153,089 discloses the "upgradation" of undesirable olefinic liquid hydrocarbon streams to high value petrochemical feedstocks e.g. ethylene, propylene, butylene, toluene and xylenes, through simultaneous reforming and cracking reactions using multifunctional solid catalyst in a circulating fluidized bed reactor-regenerator system. Conversion of olefins is fundamental to this process however the products are simply different olefins, useful for petrochemical feed but not allowed in crude oil pipelines, and generally not as a part of a refinery feedstock stream. This process does not pursue nor achieve the desired outcome; preparation for crude pipeline transport to refining customers.

U.S. Pat. No. 3,325,552 describes dehydrogenation and cyclization of olefinic material through a method of preparing aromatic hydrocarbons in a catalytic conversion zone involving a hydrocarbon having a mono-olefin open chain of only from 4 to 6 carbon atoms in length and a total of 6 to 20 carbon atoms with a catalyst having the three different metal oxides. The catalyst blend uses a mix of zinc oxide, magnesia and alumina to convert mono-olefin hydrocarbon chains through dehydrogenation and cyclization. The catalyst used in this patent does not cause the dehydrogenation of alkane hydrocarbons. However, to "seed" the reaction, aromatics preferably benzene are necessary which increases the complexity of the process and the objective of this process is a more intensive set of reaction pathways than olefin conversion through cyclization as an example.

WO patent application 1989010190 A1 describes a catalyst, made of zinc oxide, magnesia and alumina, for converting paraffins, olefins or mixtures of both into a hydrocarbon product rich in aromatics and a gas of high energy content. The catalyst comprises a crystalline gallium-silicate of the zeolite (ZSM-5) family. The limitations of this patent is its specificity to olefins in the feed such as ethylene and propylene, creation of specific aromatic desired products such as benzene, and toluene and the unnecessary conversion of paraffins. In addition, the catalyst has a limited applicability and is not suited for streams with olefins in the liquid phase at ambient conditions generated from thermally cracked heavy hydrocarbons.

U.S. Pat. No. 3,856,660 discloses a reforming process comprising contacting naphtha and hydrogen with a catalyst comprising a refractory support promoted with platinum, iridium and gallium creating a refinery reformate stream rich in aromatics. The stream and catalyst type is of interest yet this '660 patent requires added hydrogen to complete the desired reaction and the reaction pathway is more complicated than in a direct olefin conversion cyclization.

U.S. Pat. No. 6,284,128 describes a process for upgrading a naphtha feedstock to obtain an aromatics-enriched, low-olefin product comprised of two steps; reforming the feedstock with a catalyst containing a supported platinum-group metal component in a reforming zone in the presence of hydrogen at reforming conditions to obtain an olefin-containing reformate. A key shortcoming of this patent is the use of a supplemental hydrogen-rich gas creating the necessary hydrogen partial pressure to promote the olefin conversion.

U.S. Pat. No. 8,318,003 describes an aromatic producing process for catalytic conversion of Fisher-Tropsch derived olefins to distillates. This process includes the step of contacting Fisher-Tropsch derived olefins with a Zeolyte type catalyst at pressures of more than 50 bar. The conversion includes oligomerising and isomerising of the Fisher-Tropsch derived olefins to produce an intermediate olefinic stream followed by a hydrotreating step requiring hydrogen. The initial step does not convert the olefins to another molecule type but converts the olefins to a different olefinic molecule like that described in U.S. Pat. No. 6,153,089 (discussed above). It then contemplates a second step of hydrotreating to saturate these new olefins which is an added difficulty.

SUMMARY OF THE INVENTION

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

A Direct Olefin Reduction (DOR) process is employed to selectively convert olefin components in a portion of a thermally cracked liquid hydrocarbon stream, reducing the olefin content of the hydrocarbon stream to levels that comply with pipeline specifications for crude oil transport and refinery feedstock. The DOR process employs chemistry and a reaction pathway not currently contemplated in the art nor current commercial practice for this purpose. Cyclization, isomerisation, and aromatization provide reaction pathways to simply rearrange intramolecular bonds to eliminate olefinic bonds, without requiring the addition of supplemental hydrogen. The necessity for supplemental hydrogen to treat cracked molecules represents the largest portion of facility cost and complexity currently endured for this application or contemplated in the prior art. (e.g. Canadian patent 2,916,767 and U.S. Patent application 61/843,002). Eliminating this need through different chemistry greatly improves the cost effectiveness and reliability of thermally processing heavy hydrocarbons.

The invention employs a fixed bed reactor with a catalyst specifically formulated to selectively convert olefins primarily through cyclization and aromatization reaction pathways. An olefin-containing stream flows through the fixed bed reactor at appropriate pressure and temperature operating conditions, contacting the catalyst which facilitates the desired reactions. The preferred catalyst is formulated from a combination of noble and precious metals bonded to an appropriate support in a fixed bed reactor. No supplemental hydrogen is injected into the reaction zone beyond the hydrogen contained in the hydrocarbons in the feed stream for the reactor.

In one embodiment, the olefin reduction is achieved by its conversion through a cyclization reaction pathway without supplemental hydrogen or introduced donor molecules in the reaction.

In another embodiment, the olefin reduction is achieved by its conversion through an aromatization reaction pathway without added hydrogen or introduced donor molecules in the reaction.

In a further embodiment, the olefin reduction is achieved by its conversion through an isomerisation reaction pathway without added hydrogen or introduced donor molecules in the reaction.

In a further embodiment, the olefin reduction is achieved by conversion through a combination of cyclization, isomerisation, and aromatization reaction pathways, or at least two of those pathways, without added hydrogen or introduced donor molecules in the reaction.

In an embodiment, the process involves the selection and control of a. catalyst components and substrate, b. process conditions of pressure and temperature, c. energy input into, and removal from the reaction, to control the reaction pathway for olefins in the liquid hydrocarbon feed stream. This selection and control also minimizes conversion of non-olefinic molecules, and limits less desirable reactions including a. desulfurization, b. denitrification, c. demetallization, and d. hydrocracking.

In an embodiment, the invention provides for a one-step process for reducing olefin content in an olefin-containing hydrocarbon stream to meet crude pipeline olefin content specification restrictions by contacting the olefin-containing stream with a combination of noble and precious metals on a catalyst support in a fixed bed reactor with no source of hydrogen beyond the hydrocarbons in the feed stream for the reaction(s).

In a further embodiment, the olefin removal is achieved by its conversion through one or more of a cyclization, aromatization and isomerization reaction pathways without supplemental hydrogen or introduced donor molecules in the reaction. In the olefin conversion process of the invention, the reaction is selective to olefins in the heavy hydrocarbon stream by at least one of: selection of catalyst used; and control over energy inputs to the reaction. Minimal conversion of non-olefinic molecules occurs, side reactions such as hydrodesulfurization, demetallization, hydrocracking and denitrification are controlled and limited, with the main effect of the reaction being to convert olefins in the process fluid. In various embodiments, the catalyst support is alumina, silica or zeolite-based with one or more of: platinum group metals (ruthenium, rhodium, palladium, osmium, indium and platinum), noble metals (silver, gold), transition metals (cobalt, nickel, copper, zinc) or post-transition metals (gallium, lead, tin, aluminum).

In an embodiment the olefin conversion reaction is by one or more of a one-step: cyclization, aromatization, and isomerization reaction pathway, without supplemental hydrogen or introduced donor molecules in the reaction. The reaction is selective to olefins by at least one of: selection of catalysts used; and limiting energy input to the reaction, where olefin conversion is over 75 wt % with minimal conversion of non-olefinic molecules.

Side reactions such as hydrodesulfurization, demetallization, hydrocracking and denitrification are controlled and limited, leaving the main effect of the process being conversion of the olefins in the olefin-rich stream.

The precious metal concentration of the catalyst is 0.01 to 10 wt %.

In an embodiment, the olefin conversion reaction is carried out in a vessel that is sized for flows between liquid hourly space velocities of 0.1 and 2 h-1 at between atmospheric pressure and 140 bar (2,000 psig) and at temperatures between 300° F. and 662° F. (150-350° C.).

In an embodiment a guard bed is used upstream of the main catalytic bed in the fixed bed reactor to remove contaminants from the hydrocarbon stream to be processed. A catalyst support is provided in the fixed bed reactor comprised of any of alumina-based, silica-based and/or zeolite material or a combination of all material.

In an embodiment the process is applied after treatment of all or a portion of a virgin heavy hydrocarbon stream such as bitumen in a thermal or catalytic process that produces olefins thereby enriching the hydrocarbon stream with produced olefin, the process comprising then sending the olefin-enriched hydrocarbon stream to a one-step direct olefin conversion processor which uses a selective cyclization reaction pathway to reduce olefins. The conversion of olefins reduces olefin content in the processed olefin-rich stream to levels which meet pipeline specification restrictions for olefins.

In an embodiment, products such as cyclo-paraffins, napthalenes and aromatics are created from the olefin-enriched stream where olefins in the olefin-enriched stream are converted and reduced in order to meet pipeline olefin specification restrictions.

In a process embodiment, a C1-C4 gas mixture is added to the reactor with the heavy hydrocarbon stream to promote olefin conversion reactions.

In an embodiment two reactor beds are placed in parallel to provide continuous operation with one on-line and the other regenerating and/or on stand-by.

In an embodiment a reactor apparatus is provided, comprising:

(a) An inlet to introduce an olefin-containing hydrocarbon process fluid into a reactor body;

(b) The reactor body containing a reactor bed, with catalyst support for flowing process fluid to contact the reactor bed;

(c) The reactor bed comprising a catalyst bed with included metal catalysts;

(d) The metal catalysts comprising at least one metal from any of: platinum group metal, precious metals, transition metals or post-transition metals;

(e) The reactor catalyst having pores sized to accommodate the size and shape of unconverted and converted olefin molecules produced in the reactor from the process fluid;

(f) The reactor catalyst having appropriate acidity to maintain necessary cyclization reactions while mitigating cracking reactions;

(g) Temperature, pressure and flow control means to control process conditions imposed in the reactor upon process fluid introduced into the reactor;

(h) An outlet from the reactor for removal of converted process fluid from the reactor.

DETAILED DESCRIPTION

Figure 1:
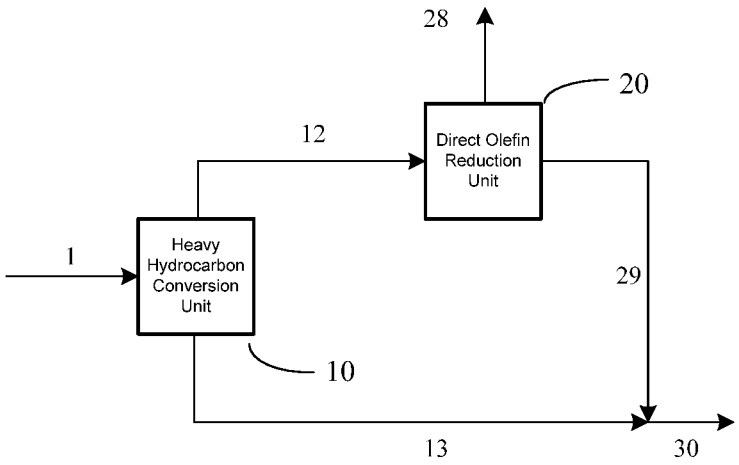
FIG. 1 depicts the integration of the direct olefin removal unit with a heavy hydrocarbon processing unit.

Introduction:

Olefins (alkenes) are readily produced by β-scission reactions during the pyrolysis of hydrocarbons as occurs in thermal cracking reactors. This produces a product with relatively high concentrations of olefins in the lighter hydrocarbon fraction (IBP—650° F.). Olefins, particularly in the naphtha fraction (IBP—350° F.), are an undesirable component of a crude feed to a refinery because of their high reactivity, which leads to polymerization, producing gums and sludge that can foul equipment. Because of the high reactivity and tendency to polymerize, pipelines have placed limits on olefin concentration and now require essentially zero olefin content of pipeline products (non-detectable which is <0.5 wt % with current measurement techniques).

Conventional practices to remove olefins from pyrolysis products, such as coker distillate, rely on hydrotreating the olefins to saturate the double bond. Hydrotreating is an oil refinery catalytic process in which hydrogen is contacted with petroleum intermediate product streams to remove impurities, such as oxygen (O), sulfur (S), nitrogen (N), or unsaturated hydrocarbons (olefins). Fixed bed hydrotreating is the industrial standard for reducing S and N in upgraded/refined products. To achieve the S and N reduction, this process basically converts all of the olefins in the hydrocarbon stream to a saturated product. However, this is an expensive approach to reduce the olefin content only of the naphtha and light distillate fractions. Hydrogen is expensive to either purchase or produce. The reactors are high pressure/high temperature vessels that are expensive, catalyst is expensive, and the operating costs are high. In addition, hydrogen generation for hydrotreating bitumen in upgrading and refining is a large contributor to the cost of the upgrading process and to the generation of greenhouse gas (GHG) emissions. The industry in general and bitumen upgraders specifically, would benefit from a non-hydrogen based technology that would efficiently remove olefins at a lower cost. Direct olefin reduction (DOR) is a process intensification technology concept advancement using the cyclization reaction pathway, as an example, that can both reduce costs and GHG emissions by removing the need to generate hydrogen.

The objective of the DOR is to reduce the cost of converting olefins through a different approach than hydrotreating cracked hydrocarbons generated during the heavy oil conversion process, by limiting the reaction to just olefins while minimizing sulfur and nitrogen species reactions and thus reducing the size and cost of the sulfur handling facilities. Olefin treatment is necessary as long as there is a restrictive olefin specification (<0.5 vol %) on transport pipelines.

Cyclization reactions are organic chemical transformations that yield cyclic products via conversion of molecules such as olefins, as an example, to produce mono- or polycyclic pipeline acceptable products. Because they are intramolecular transformations, they are often very rapid and selective. Selective reaction chemistry can be achieved at carbons bound to a variety of functional groups, and mechanisms such as catalysis to effect cyclization generation are numerous. The cyclization step usually involves the cleavage of a multiple bond. The two ends of the multiple bond constitute two possible sites of reaction. The broken bond provides an attractive location for another bound atom or unbound atom to bind as a cyclic product. Five- and six-membered rings are the most common products; formation of smaller and larger rings is rarely observed.

The carbon-carbon double bond of an olefin appears to be a stronger bond than a standard carbon-carbon or carbon-hydrogen bond with a high total bond energy (~613 kj/mol) but this comprises of two single carbon-carbon bonds which alone have a bond energy of μ347 KJ/mol. The bond energies from each single carbon-carbon bond are not additive when creating the double bond (<697 KJ/mol). As a result, the bond energy to break one of the carbon double bonds is ~307 kJ/mol (on average) which is less than a single carbon-carbon bond and less than a carbon-hydrogen bond (~413 KJ/mol). Selective breaking of the carbon-carbon double bond can be achieved with the appropriate process design (ex. catalyst type and pore size) and conditions (eg. temperature, pressure and flow rate). The reaction may be tailored by selection of catalysts and controlling energy input to the process.

Overall, three conditions must be met for efficient cyclization to take place: A method must be available to generate olefin bond breakage selectively on the catalyst substrate, atoms are attracted to generate non-multiple bonds, and all steps must be faster than any undesired side reactions such as olefin recombination or reaction with sulfur and/or nitrogen bearing bonds. Cyclization reaction conditions are often mild and functional group tolerance is high. However, the catalytic process needs to ensure that the relative rates of the various potential side reactions must be carefully controlled so that cyclization is favored. Side reactions need to be mitigated.

Formation of aromatics during the pyrolysis of hydrocarbons has been observed since the beginning of the utilization of pyrolysis of hydrocarbons. Nohara and Sakai have elucidated a proposed reaction mechanism to explain the observed chemistry as is shown in Note 1. The reaction is a Diels-Alder cyclization reaction involving olefins and diolefins produced during pyrolysis. Although the reaction does occur, it is not a primary pyrolysis reaction and is considered a secondary reaction. As a result, the conditions required to produce the aromatics are relatively extreme and the yield of aromatics from this reaction are low. However, the reaction does proceed at a measurable rate, but has been considered a novelty.

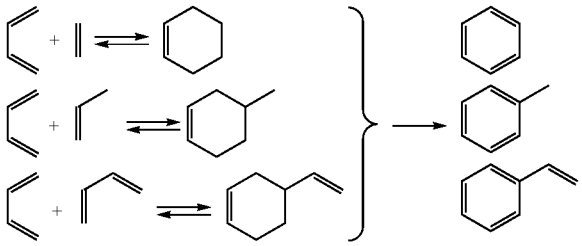

Note 1. Diels-Alder cyclization reaction involving olefins and diolefins to yield mono aromatics (Nohara, Daisuke, and Tomoya Sakai, 1973, *"Thermal Reaction of* 1, 5-*Hexadiene. Mechanism Proposal", Ind. Eng. Chem. Prod. Res. Develop.,* 12, (4), pp. 322-325).

Interestingly, this is the same fundamental chemistry that is the basis for the refinery process of naphtha reforming. Naphtha reforming is a standard refinery process used to convert low molecular weight alkanes into higher value aromatics for octane enhancement and feedstocks for the petro chemical industry. The process occurs in the presence of a noble metal catalyst and a high partial pressure of hydrogen. Three main reactions occur that generate hydrogen creating the high hydrogen partial pressure, the dehydrogenation of naphthenes, isomerization of paraffins and dehydrogenation/aromatization of paraffins. A fourth reaction, the hydrocracking of paraffins also occurs due to the presence of generated hydrogen. Typically the feed to refinery reformers are low in sulfur, with a desulfurization step upstream of the unit, and contain very low concentrations of olefins.

The invention of this application can use similar catalyst but differs in that the target feedstock contains large concentrations of olefins (~20 wt %) and the process may tolerate higher sulfur and nitrogen feedstocks.

Understanding and application of the reforming chemistry was further expanded during the 1980's. Tetra-ethyl lead was removed from gasoline as an octane booster for environmental reasons and without tetra-ethyl lead, the octane pool was not sufficient to produce the needed gasoline. Efforts were made to develop technologies to produce an octane booster, in particular benzene, toluene and xylene (BTX). A readily available feedstock for aromatization was liquefied petroleum gas (LPG). During the 1980's a great deal of research was conducted to understand the chemistry of the aromatization reactions and the effectiveness of various catalysts.

This chemistry has resulted in the development of three commercial processes that are indicated to be applicable to both naphtha reforming and LPG aromatization. The commercial processes are:

M-2 Forming (Mobil)

Cyclar (BP-UOP)

Aroforming (IFP-Salutec)

The chemistry of the aromatization of alkanes was elucidated with model compounds and since the emphasis at that time was on aromatization of LPG, most of the work was performed on propane, butane and hexane because they are representative of the components in LPG. However, this chemistry is also applicable to the higher molecular weight components in naphtha. The chemical mechanism for the aromatization is shown below in Note 2.

The reaction begins with step 1, dehydrogenation of an alkane (in the case of Note 2—propane) to form an olefin. Unlike pyrolysis chemistry, which is free radical chemistry, this dehydrogenation occurs by carbenium ion chemistry rather than by β-scission. Steps 2 and 4 in the reaction mechanism involve transient intermediates that first react the olefins to yield oligomers, quite possibly the reaction involves some di-olefins. The oligomers undergo cyclization reactions in step 4 to produce alicyclics like cyclohexane. The alicyclics undergo dehydrogenation in step 5 to yield the desired aromatics.

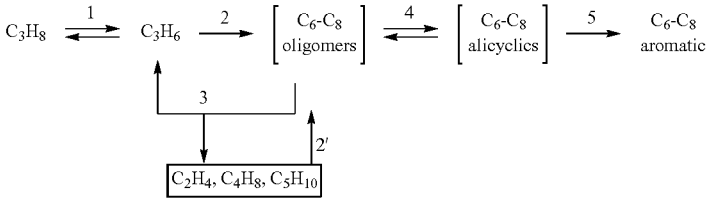

Note 2 Reaction scheme for propane aromatization on HZSM5 catalysts. The brackets round C6-C8, non-aromatic compounds mean that these compounds, which are highly thermodynamically unfavored, appear only as traces (Gnep, N. S., J. Y. Doyemet, A. M. Seco and F. Ramoa Ribeiro, 1988, *"Conversion of Light Alkanes to Aromatic Hydrocarbons II. Role of Gallium* Species *in Propane Transformation on GaHZSM*5 *Catalysts*", Applied Catalysis, 43 pg. 155-166).

Step 3 is a form of the reverse reaction of step 2 and is a cracking type of reaction. However, the reaction is not limited to producing only C3 olefins as other carbon numbered olefins can also be produced. Step 2 will convert these olefins back into the oligomers so the forward reaction (4) is favored. It is interesting to note that the dehydrogenation reaction (step 5) is not reversible. Therefore, the production of the aromatics is not equilibrium controlled.

The reaction mechanism presented in Note 2 uses the olefin (propene) as the intermediate to yield the oligomers for cyclization and aromatization. This being the case, then substituting an olefin in place of an alkane as the feedstock should favorably help the reaction and be more applicable to the problem at hand. When propene is used as the feedstock in place of propane the conversion of propene is essentially complete and the reaction is about 20 times faster than with propane. Substituting hexene for hexane in the reaction results in a rapid and selective conversion of hexene into aromatic products with practically no cracking products. Therefore, since the current application is targeting the conversion of olefins in the feedstock with up to 20 wt % concentration in the feed, the chemistry is favorable to the goals of this invention, and differs from the goals and design of refinery reforming where olefins in the feed are discouraged.

In addition, using olefins, rather than alkanes, is energetically more attractive. Table 1 provides the temperature for conversion of several alkanes to either alkenes or aromatics without a catalyst. As can be observed from the results in the Table 1, the temperature to convert any of the alkanes to an olefin is much higher than the temperature required to convert the alkane to benzene. In addition, as the number of carbon atoms in the alkane increase, the required temperature decreases.

TABLE 1

Temperature requirements to convert selected alkanes to aromatics or olefins (Scurrell, M. S., 1988, "Factors Affecting the Selectivity of the Aromatization of Light Alkanes on Modified ZSM-5 Catalysts", Applied Catalysis, 41 pg. 89-98.).

| | Temperature required for $\Delta G_r^0 = 0$ (° C.) | |
|---|---|---|
| Alkane | Conversion to benzene | Conversion to alkene |
| Methane | 1075 | 1350 (Ethene) |
| Ethane | 575 | 774 (Ether) |
| Propane | 450 | 655 (Propene) |
| n-Hexane | 320 | 575 (2-Methylpropene) |

In terms of the interest to convert olefins to aromatics, the results in Table 1 may be interpreted to mean that the conversion of olefins to aromatics should proceed more easily than conversion of the alkane to the olefin. The results discussed above show this to be the case and the results in Table 1 suggest that the high energy step in the reaction shown in Note 2 is the formation of the olefin in step 1 (high activation energy) and is likely the rate limiting step in the overall reaction.

The aromatization reactions are performed over a catalyst, often ZMS-5 zeolite catalyst with exchange heavy metal cations (zinc, platinum or gallium). The zeolite catalysts are known to be acid catalysts acting primarily as a Brönsted acid. In the aromatization of alkanes, the acid functionality of the zeolite catalyst is required to form an olefin from the alkene through the carbenium ion chemistry. The acidic activity is native to the catalyst and as a result using the zeolite as the basis for the catalyst will impart some acidic activity.

The exchange metal cations are bi-functional and participate in the dehydrogenation of the alkane (step 1 in Note 2) and the dehydrogenation of alicyclic intermediates to yield aromatics (step 5 in Note 2). Studies comparing the activity of ZSM-5-H with ZSM-5-Zn show that the addition of the Zn is advantageous for the reaction to yield high levels of aromatics. The general consensus is that zinc (Zn) functions to provide the activity to initiate reaction step 1 and does quite well providing the activity for dehydrogenation to yield aromatics.

Platinum (Pt) has also been shown to have a high degree of dehydrogenation activity. However, it also appears that Pt also has significant cracking and de-alkylation activity and yields of cracked products (step 3 in Note 2) are increased. In addition, the yield of benzene is increased at the expense of C8 aromatics (xylenes). The activity of Pt appears to catalyze significant retrograde reactions that equate to carbon rejection for the process. For this reason, Pt is not frequently used in commercial aromatization processes. Other platinum group metals such as ruthenium, rhodium, palladium, osmium, or indium may provide less cracking and could be used for the aromatization reactions. Gallium (Ga) has also been used as the exchange metal cation in the zeolite catalysts. The activity of Ga has been shown to be similar to that of Zn and Pt in that it promotes step 1 (Note 2) as well as being active in dehydrogenation of the alicyclic components (step 5 in Note 2). However, the alicyclic dehydrogenation activity of Ga appears to be higher than that observed for the other two metals. Gallium is not plagued with volatility or de-alkylation issues and is a metal preferred for use in the commercial catalyst. Other post-transition metals such as tin, aluminum or lead could provide similar benefits and could be substitutes to gallium.

Certain noble metals (silver, gold), and transition metals (cobalt, nickel, copper, zinc) have been used as catalysts for various degrees of cyclization, aromatization and isomerazatoin reactions and could be candidates for direct olefin conversion.

The conversion of a number of C6 isomers has been studied over the aromatization catalysts and provides some insight into the application of this chemistry to conversion of olefins. The results from this study found that the decreasing order of reactivity of the isomers was: n-hexane>3-methylpentane>2,2-dimethylbutane. This order of reactivity is the reverse of that expected based on classical carbonium ion chemistry. However, the order of reactivity does imply limitations in the access of the reactant to the catalyst.

Catalyst activity resides on both the surface of the catalyst and within the pore structure. When the catalyst is "fresh", the reactivity of the branched isomers is high, indicating probable conversion on the surface. As the catalyst ages, the reactivity decreases as expected for surface activity. However, the activity does not cease and suggests a high degree of diffusion control of the reaction based on the capability of the branched isomers to enter the pore structure of the catalyst. This suggests that control of the pore size of catalysts selected for olefin aromatization will need to be tailored because deactivation at the surface will occur before deactivation within the pore structure. Then the reaction rate will be diffusion controlled. Another consideration for pore size in this application is that the product molecules will tend to have different shapes and could be larger than the feed molecules and could be trapped in the catalyst if the pore size selection does not account for the geometry of the reaction product molecules.

Cyclization reactions, such as the Diels-Alder reaction mechanism, and aromatization reactions, which convert alkanes or olefins to cyclo-paraffins and aromatic species respectively have been observed and studied in pyrolysis of hydrocarbons. This chemistry has been extended to petroleum refining and aromatization is the fundamental chemistry utilized for naphtha reforming and conversion of liquefied petroleum gas (LPG) to benzene, toluene, and xylene (BTX). The aromatization chemistry has been successfully applied to these processes. However, to date, reference to the cyclization and aromatization chemistry for the reduction of olefin content in olefin rich naphtha and kerosene (light distillate) has not been found.

Another instance of olefin conversion can result from isomerization reactions which are a more selective form of cyclization (i.e. cycloisomerization) in which cracked hydrocarbon molecules are transformed into molecules that have the same number of atoms but the atoms have a different arrangement. The resulting arrangement does not include any double bonds (no olefins) and the molecules can be linear in nature or cyclical.

Table 2 shares the average heat of reactions for the typical hydrogen-based catalytic conversion reactions with the reactions organized from "least energy" required to the "most energy" required. Olefin saturation reactions require the least energy so a simple reaction process strictly for olefin removal such as cyclization or cycle-isomerization can be targeted in lieu of commercial hydrotreating.

TABLE 2

Average Heat of reaction for hydrotreating reactions (Tarhun 1983, Gary & Handwerk 2001)

| Reaction | Average Heat of reaction J/mol |
|---|---|
| Olefin Saturation | −340,000 |
| Mild Hydrodesulfurization (mercaptans, Sulfides) | −251,000 |
| Hydrogenation (di, tri-aromatic rings) | −125,500 |
| Medium hydrodesulfurization (disulfides, thiophenes) | −95,000 |
| Hydrodemetallization | −72,000 |
| Hydrodeoxygenation | −68,000 |
| Hydrodenitrogenation | −64,650 |
| Severe hydrodesulfurization | −58,000 |
| hydrodearomatization (mono, di, tri aromatic rings) | −53,000 |
| Hydrocracking | −41,000 |

By only promoting olefin conversion reactions (breaking the carbon-carbon double bond), while having no effect on the other hydrocarbon molecules, less byproducts such as hydrogen sulfide ($H_2S$) are generated compared to hydrotreating processes, thereby decreasing the complexity and cost of the facility that uses an olefin removal unit instead of a hydrotreater. In most cases, refiners do not pay the full value for sulfur and nitrogen removal in their purchased heavy hydrocarbon feeds so hydrotreating prior to transport to the refinery does not appear to provide the necessary benefit for the cost. Heavy hydrocarbon conversion facilities such as partial and conventional upgraders would realize significant cost savings and process simplification from a targeted direct olefin removal technology to meet crude pipeline specification along with exhibiting a lower greenhouse gas footprint.

DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Direct olefin reduction is a process intensification/simplification of hydrotreating, removing the hydrogen production and consumption steps, that is used to remove olefins and other molecules from hydrocarbons that were generated during hydrocarbon processing. Instead of using hydrogen and a catalyst to remove olefins as in conventional hydrotreating, a specific catalyst is only used on the target hydrocarbon stream to preferentially convert olefins to non-olefinic hydrocarbons such as cycloparaffins, napthalenes and aromatics. FIG. 1 shows a specific application for the direct olefin removal unit 20, as a supporting technology to a heavy hydrocarbon conversion unit 10. Examples of unit 10 that can be integrated with unit 20 are heavy oil and bitumen upgraders, heavy oil and bitumen partial upgraders and any crude refining entity interested in a lower cost solution with the objective of olefin conversion only.

Figure 2:
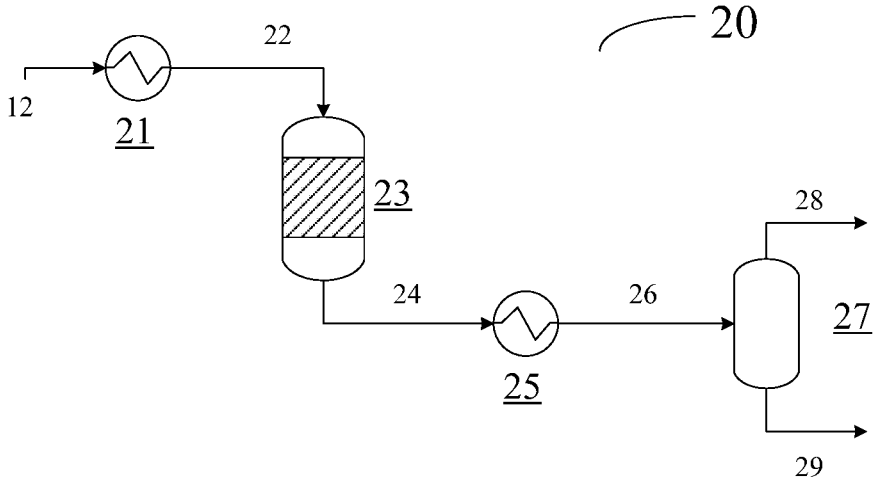
FIG. 2 depicts the streams and equipment associated with the direct olefin removal unit.

A heavy hydrocarbon stream, 1, is sent to a heavy hydrocarbon processing unit, 10, which can comprise of one or a plurality of conversion and/or separation operating units, where two product streams are generated. The heavier hydrocarbons exit unit 10 as stream 13 and are re-blended with the olefin reduced stream 29 to make a final product, stream 30 for pipeline transport to a downstream hydrocarbon processing customer (refinery). The lighter hydrocarbons with a concentration of olefinic material exit unit 10 as stream 12. Stream 12 is directed to the direct olefin removal unit 20. As shown in FIG. 2, if required, stream 12 passes through a heat exchanger, 21, to obtain the necessary operating temperature for the feed, stream 22, then to the direct olefin removal reactor 23. Reactor 23 contains a fixed bed with one or more of: platinum group metals (ruthenium, rhodium, palladium, osmium, indium and platinum), noble metals (silver, gold), transition metals (cobalt, nickel, copper, zinc) and post-transition metals (gallium, lead, tin, aluminum), the catalysts formed with silica or shape selective substrate (ex. Zeolite class) support. The olefin-rich stream interacts with the catalyst so that the olefinic bonds are selectively converted reducing the concentration of olefins from stream 22 to a point that when output stream 29 is blended with stream 13, this results in a final product stream 30 which satisfies pipeline specification for olefins. The non-olefinic molecules present in the reactor are not reacted or are minimally converted from passing through the fixed catalyst bed. For example, since the non-hydrogen addition cyclization reaction is endothermic (hydrotreating olefin saturation is mildly exothermic), the reactor may have supplemental heat added to maintain a desired operating temperature. In practice, two to three reactors in parallel can be provided to facilitate regeneration of catalyst by switching between reactors so continuous operation can be maintained. Product stream 24 exits reactor 23 with a significantly reduced concentration of olefins. Stream 24 is cooled in heat exchanger 25 creating a specific two-phased flow stream 26 ready for downstream separation. Stream 26 is sent to a separation vessel where the hydrocarbons that are suitable for the final blend stream 30 to meet pipeline specification are condensed to the liquid phase to become stream 29. Stream 29 blends with stream 13 in FIG. 1 to become the final product stream 30, a crude product that can be sent via pipeline to customers. The light hydrocarbon gases generated from the reactor 23 are removed as vapour from vessel 27 as stream 28.

In instances when the heavy hydrocarbon stream contains contaminants that can adversely affect the performance of the catalyst, such as sulfur-based, nitrogen-based, inorganic-based and/or other deactivating molecules, an absorbent or catalytic bed (e.g. guard bed) can be placed upstream of the main catalytic bed. The guard bed can be housed in the same reactor vessel as the main catalyst or placed in a separate vessel upstream for ease of regeneration.

Figure 3:
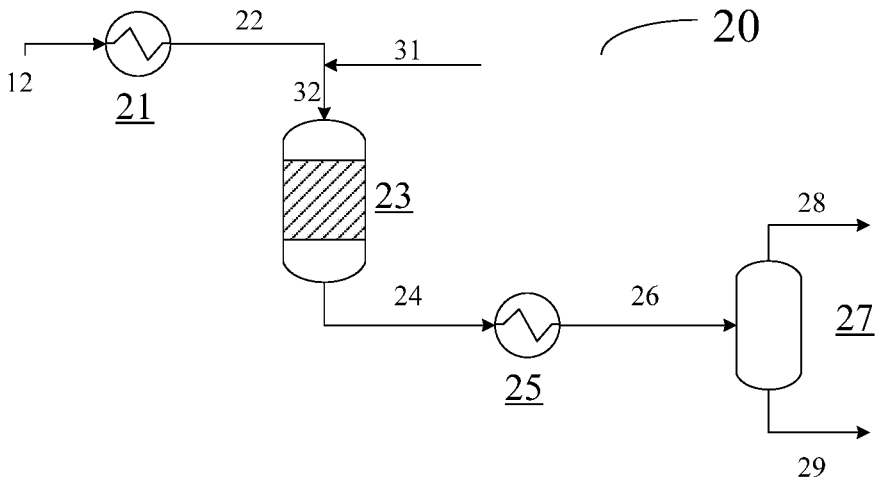
FIG. 3 depicts an embodiment of FIG. 2 with addition of a promoting stream to the direct olefin conversion reactions.
Figure 4:
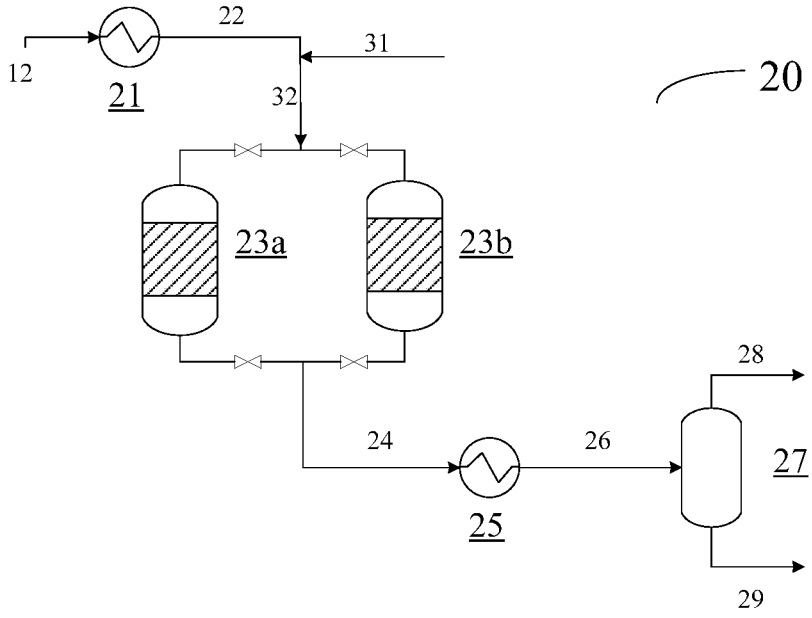
FIG. 4 depicts the use of two reactors in parallel to permit continuous operation.

Low carbon number molecules (ex. methane, ethane, propane, butane) are generated in the thermal cracking step and form part of the olefinic feedstock to the direct olefin conversion unit. These low carbon number molecules can enhance the cyclization reaction. In another embodiment, as shown in FIG. 3, a dedicated stream, 31, of a mixture of low carbon number molecules such as methane, ethane, ethylene, propane, propylene, butane and butylene are added to the feedstream 22, to create a stream 32 feeding reactor 23 to supplement the existing low carbon number molecules in stream 22 to enhance the olefin conversion reactions in reactor 23.

EXAMPLE 1

A fluid stream 12 as referenced in FIG. 1, comprising naphtha and distillate boiling range material with 20 wt % olefin content was placed in a fixed bed reactor with catalyst containing 0.1 wt % of a silver and gallium mix on a zeolite substrate. With operating conditions at 350° C. and 15 bar, and a residence time of 1 hour, the olefin conversion was over 75 wt % with a 98 wt % mass liquid yield while the demetallization, desulfurization and denitrification reactions were negligible. The product liquid from this fixed bed reactor representing stream 29 in FIG. 1 when mixed with stream 13 in FIG. 1 would result in a stream 30, that meets pipeline olefin specification.

EXAMPLE 2

A fluid stream 12 as referenced in FIG. 1, comprising naphtha and distillate boiling range material with 20 wt % olefin content was placed in a fixed bed reactor comprising catalyst containing 0.1 wt % of platinum on an extruded alumina oxide cylinder. With operating conditions at 300° C. and 70 bar, and a residence time of 1 hour, the olefin conversion was over 98 wt % with a 98% mass yield while the demetallization, desulfurization and denitrification reactions were negligible. The product liquid from this fixed bed reactor representing stream 29 in FIG. 1 when mixed with stream 13 in FIG. 1 resulted in stream 30 that met pipeline olefin specification.

What is claimed is:

1. A process for producing an upgraded hydrocarbon product, comprising:

subjecting a heavy hydrocarbon stream to a thermal cracking treatment o produce an olefin-containing hydrocarbon stream and a cracked bitumen stream;

supplying the olefin-containing hydrocarbon stream to a catalytic reactor for contacting a catalyst material without the addition of supplemental hydrogen to convert olefins and produce a treated hydrocarbon stream with a reduced olefin content, the catalyst material comprising:

a support material; and a catalytic metal material comprising:

an olefin cracking metal catalyst to crack olefins into smaller hydrocarbon components; and a reforming metal catalyst for converting the smaller hydrocarbon components into longer-chain hydrocarbons by reaction pathways that include polymerization, cyclization and aromatization;

withdrawing the treated hydrocarbon stream from the catalytic reactor.

2. The process of claim 1, wherein the heavy hydrocarbon stream is a bitumen stream.

3. The process of claim 2, wherein the thermal cracking treatment is performed in a thermal cracking unit from which the olefin-containing hydrocarbon stream and the cracked heavy hydrocarbon stream are removed.

4. The process of claim 3, further comprising combining at least a portion of the cracked heavy hydrocarbon stream and at least a portion of the treated hydrocarbon stream to form a combined hydrocarbon stream.

5. The process of claim 4, further comprising cooling the treated hydrocarbon stream after withdrawal from the catalytic reactor, and separating the cooled treated hydrocarbon stream into a vapour stream and a liquid stream.

6. The process of claim 5, wherein the liquid stream is combined with at least a portion of the cracked heavy hydrocarbon stream to form the combined hydrocarbon stream.

7. The process of claim 1, further comprising adding a supplementary stream comprising low carbon number molecules to the olefin-containing hydrocarbon stream prior to supplying to the catalytic reactor.

8. The process of claim 7, wherein the low carbon number molecules comprise olefins.

9. The process of claim 7, wherein the low carbon number molecules comprise methane, ethane, ethylene, propane, propylene, butane or butylene or a combination thereof.

10. The process of claim 1, wherein the catalytic reactor comprises a vessel sized for flows between liquid hourly space velocities of 0.1 $h^{-1}$ and 2 $h^{-1}$.

11. The process of claim 1, wherein the catalytic reactor is operated between atmospheric pressure and 70 bar.

12. The process of claim 11, wherein the olefin cracking metal catalyst comprises silver and the reforming metal catalyst comprises gallium.

13. The process of claim 1, wherein the catalytic reactor is operated between 70 bar and 140 bar.

14. The process of claim 13, wherein the olefin cracking metal catalyst comprises silver and the reforming metal catalyst comprises platinum or palladium.

15. The process of claim 1, wherein the catalytic reactor is operated at temperatures between 300° F. and 662° F.

16. The process of claim 1, wherein the olefin-containing hydrocarbon stream is liquid phase when entering the catalytic reactor.

17. The process of claim 1, wherein the catalytic reactor comprises:

a main catalytic bed comprising the catalyst material; and an upstream pre-treatment unit configured to remove contaminants, the upstream pre-treatment unit comprising a catalytic bed or an absorbent bed and being configured to remove at least sulfur-based molecules that would have deleterious effects on the catalyst material.

18. The process of claim 1, wherein the olefin cracking metal catalyst comprises at least one noble metal comprising silver.

19. The process of claim 18, wherein the reforming metal catalyst comprises at least one platinum group metal or at least one post-transition metal, or a combination thereof.

20. The process of claim 19, wherein the at least one platinum group metal is selected from the group consisting of palladium and platinum.

21. The process of claim 19, wherein the at least one post-transition metal is gallium.

22. The process of claim 19, wherein the support material has acidic activity.

23. The process of claim 19, wherein the support material comprises alumina-based material, silica-based material or zeolite material or a combination thereof.

24. The process of claim 23, wherein the support material is formed as an extruded structure.

25. The process of claim 19, wherein the catalytic metal material is present in an amount of at least 0.1 wt % and less than 10 wt % on a total weight basis of the catalyst material.

26. The process of claim 1, wherein conversion of the olefins in the catalytic reactor is at least 75 wt % based on the total amount of olefins in the olefin-containing hydrocarbon stream supplied into the catalytic reactor.

27. The process of claim 1, wherein conversion of the olefins is performed without supplemental hydrogen donor compounds added to the catalytic reactor.

28. The process of claim 1, wherein the catalytic reactor comprises:

an inlet to introduce the olefin-containing hydrocarbon stream;

a reactor body in fluid communication with the inlet to receive the olefin-containing hydrocarbon stream, the reactor body containing a flow distribution assembly and a fixed reactor bed comprising the catalyst material for flowing the olefin-containing hydrocarbon stream to contact the reactor bed;

temperature, pressure and flow control units to control process conditions imposed in the catalytic reactor;

an outlet in fluid communication with the reactor body for removal of the treated hydrocarbon stream.

29. A process for producing an upgraded bitumen product, comprising:

subjecting a bitumen stream to a cracking treatment to produce an olefin-containing hydrocarbon stream and a cracked bitumen stream;

supplying the olefin-containing hydrocarbon stream as a liquid to a catalytic reactor for contacting a catalyst material without the addition of supplemental hydrogen to convert olefins and produce a treated hydrocarbon stream with a reduced olefin content, the catalyst material comprising:

a support material; and a catalytic metal material comprising:

an olefin cracking metal catalyst o crack olefins into smaller hydrocarbon components; and a reforming metal catalyst for converting the smaller hydrocarbon components into longer-chain hydrocarbons by reaction pathways that include polymerization and aromatization;

withdrawing the treated hydrocarbon stream from the catalytic reactor;

separating the treated hydrocarbon stream to produce a vapour hydrocarbon stream and a liquid stream; and combining at least a portion of the liquid stream and at least a portion of the cracked bitumen stream to produce the upgraded bitumen product.

* * * * *